United States Patent [19]

Davis et al.

[11] 4,011,662

[45] Mar. 15, 1977

[54] AUTOMATIC VALVE ASSEMBLY AND HEATER/HUMIDIFIER CONVERTER FOR CLOTHES DRYER

[75] Inventors: Howard Coe Davis, Surrey; Nicholas Hoolsema, Langley, both of Canada

[73] Assignee: Delmarco Management Ltd., Langley, Canada

[22] Filed: Mar. 19, 1976

[21] Appl. No.: 668,493

[52] U.S. Cl. ..... 34/90; 34/86; 34/82; 55/313; 55/314; 137/119; 137/612.1

[51] Int. Cl.[2] ..... F26B 19/00

[58] Field of Search ..... 34/79, 82, 85, 86, 90, 34/133, 235; 137/527, 115, 116, 118, 119, 612.1; 251/65, 297, 624.27; 55/312, 313, 314; 210/130; 236/45

[56] References Cited

UNITED STATES PATENTS

| | | | |
|---|---|---|---|
| 2,170,074 | 8/1939 | Hewitt | 55/313 |
| 2,737,879 | 3/1956 | Cooke et al. | 137/527 |
| 2,939,474 | 6/1960 | Simone et al. | 137/119 |
| 3,066,423 | 12/1962 | Solem | 34/86 |
| 3,417,481 | 12/1968 | Rumsey, Jr. | 34/90 |
| 3,716,925 | 2/1973 | Hartung | 34/235 |

*Primary Examiner*—Kenneth W. Sprague
*Assistant Examiner*—James C. Yeung
*Attorney, Agent, or Firm*—Carver and Company

[57] ABSTRACT

Automatic valve assembly connected to outlet from clothes dryer to selectively add heat and humidity to building. Bifurcated exhaust duct assembly has manual valve and filter in first duct to exhaust into building, and automatic valve in second duct to exhaust outside building. Automatic valve is retained closed by releasable latch means which releases valve automatically when filter becomes clogged with lint to such an extent as to generate excessive exhaust pressure on upstream side of valve. Valve plate is journalled on off-centered hinge axis so as to swing to open position when exposed to exhaust flow. Pressure sensing means exposed to exhaust pressure cooperates with latch means to release the latch means when exhaust pressure exceeds pre-determined excess. Steadying means cooperates with opened valve plate to maintain plate in open position which produces negligible restriction of flow past automatic valve. Latch means includes magnetic, over-centering, resilient or pneumatic types and steadying means includes magnetic or off-centered valve plate.

14 Claims, 7 Drawing Figures

AUTOMATIC VALVE ASSEMBLY AND HEATER/HUMIDIFIER CONVERTER FOR CLOTHES DRYER

BACKGROUND OF THE INVENTION

1. Field of the Invention

The invention relates to an automatic valve assembly for connecting to an exhaust duct of a clothes dryer so that the dryer can be used also as a humidifier and heater.

2. Prior Art

Domestic clothes dryers in which clothes to be dried are exposed to hot air from a heater have been known for many years. During operation of the dryer, a relatively large volume flow of moist air at a moderately high temperature and relative humidity is exhausted from the dryer to outside the building. It is known that such dryers require relatively large amounts of heat energy and, after the drying, most of this energy is lost to atmosphere.

Humidifiers have also been known for many years, and are particularly useful in winter in buildings situated in dry areas remote from large bodies of water. During winter, low ambient temperature reduces absolute moisture content of outside air and when the outside air is drawn into the house and heated to normal temperature it attains a very low relative humidity. Thus, particularly during the winter when additional space heating is required, humidifiers are used and these also require relatively large amounts of energy.

It is known to recover the hot moist air from a clothes dryer by diverting the exhaust from the dryer into the building. This increases relative humidity and temperature of the air in the building and, to prevent lint from the clothes from passing into the building, it is usual to pass the dryer exhaust through a filter. Thus by a simple conversion the dryer can be used also as a heater humidifier during its normal drying cycle. However, the filters can quickly become clogged with lint which restricts exhaust flow from the dryer, reducing drying efficiency and commonly raising dryer temperature which can trigger an "over-heat" switch of the dryer which switches off the dryer. Occasionally lint in a dryer burns if the "over-heat" switch is not triggered, and this danger may be increased if the clogged filter is not cleaned or replaced. It may be for this reason that heater/humidifier converters using filtered exhausts from clothes dryers to increase household temperature and humidity have been relatively unpopular.

SUMMARY OF THE INVENTION

The present invention reduces the difficulties and disadvantages of the prior art by providing an automatic valve assembly in a bifurcated exhaust duct connected to a dryer outlet. The valve assembly is in one branch of the duct and has a valve which is responsive to exhaust air pressure from the dryer so that if the filter becomes blocked more than a predetermined amount, excessive exhaust pressure triggers the valve to open it. When opened the valve exhausts the hot humid air from the dryer to atmosphere outside the building. Dryer operator has a visual indication that the valve has opened and can then clean or replace the filter and close the valve so that the heater/humidifier is again operative to add heat and humidity to air inside the building.

An automatic clothes dryer valve assembly according to the invention communicates with an inlet duct which is connected to the dryer exhaust opening and divides at a duct junction into first and second exhaust ducts. The first exhaust duct exhausts into the building, carries a filter and has a manual valve adapted to close or open the first duct. The second exhaust duct exhausts outside the building and carries the automatic valve assembly. The valve assembly is characterized by a valve plate mounted for rotation about a hinge axis between closed and open positions, the plate having a central axis which divides the plate into two generally equal areas. The hinge axis is parallel to and spaced from the central axis to journal the plate off-centered so that when the plate is exposed to a predetermined flow of air, a force on the plate is generated which tends to swing the plate towards the open position. A releasable latch means cooperates with the plate to hold the plate closed until a predetermined excessive exhaust pressure is developed on an upstream side of the plate due to restriction of exhaust air flow through the filter in the first exhaust duct. Pressure sensing means exposed to exhaust pressure on the upstream side of the valve plate cooperates with the latch means to release the latch means when the exhaust pressure exceeds the predetermined excessive pressure. Steadying means cooperates with the plate to maintain the plate, when released, in the open position in which there is negligible restriction of air flow past the automatic valve.

A detailed disclosure following, related to drawings, describes preferred embodiments of the invention, which however is capable of expression in structure other than that particularly described and illustrated.

DETAILED DISCLOSURE

FIG. 1

Figure 1:
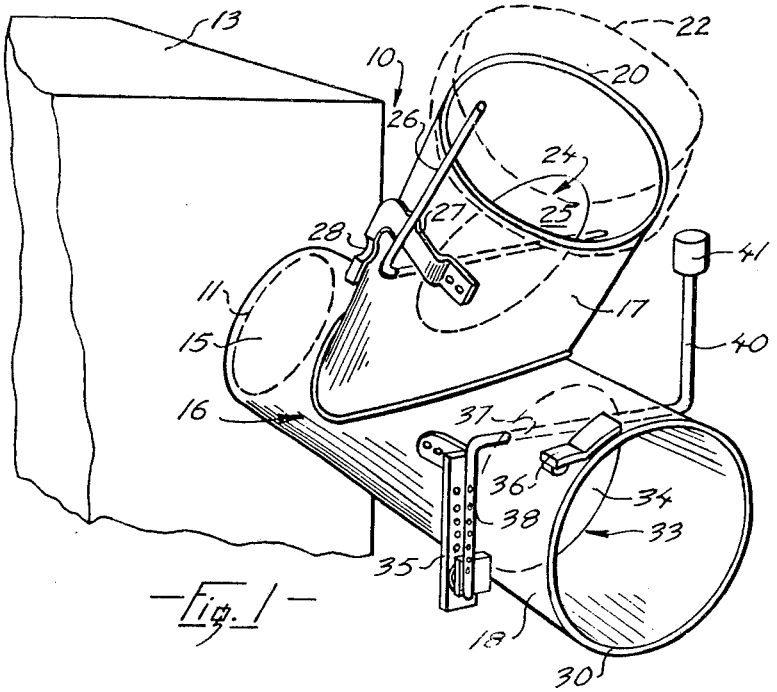
FIG. 1 is a simplified perspective of a heater/-humidifier duct assembly, using an automatic valve assembly according to the invention, the valve having magnetic latching means.

A heater/humidifier duct assembly 10 according to the invention communicates with an exhaust opening 11 of a clothes dryer 13, portions of the dryer only being shown. The duct assembly is bifurcated and has an inlet duct 15 communicating with the exhaust opening 11, and divides at a junction 16 into first and second exhaust ducts 17 and 18. The first duct has an open end 20 connected to a filter bag 22, shown in broken line and fragmented. The bag is exposed within the building so that, when additional heat and humidity are required, hot moist air from the dryer can pass through the filter to exhaust into the building. A manual butterfly valve 24 is adapted to close and open the first duct 17 and is controlled by a lever 26 which can be locked by an operator in open or closed positions by resilient latch means 27 and 28 respectively. The valve 24 is shown open so as to direct the warm humid exhaust from the dryer into the filter bag which would be the usual setting for operation of the dryer in the winter.

The second exhaust duct 18 has an open end 30 connected to a hose (not shown) which leads outside the building, and thus when the valve 24 is closed, the duct 18 conducts exhaust from the dryer to atmosphere outside the house. The second duct 18 has an automatic exhaust pressure responsive valve assembly 33 according to the invention having a valve plate 34. The valve 33 can be opened manually during the summer when normally the manual valve 24 would be closed and exhaust from the dryer is directed outside as is the practice at present in common dryers. Alternatively during the winter when the valve 24 is opened and a clean filter is fitted on the duct 17, the valve assembly 33 is releasably latched closed. As will be described, when the filter 22 becomes excessively clogged with lint, excess exhaust pressure is generated which automatically opens the valve 33. The valve assembly 33 includes a transverse rod portion 37 secured to the valve plate and carried in clearance openings in the opposite walls of the duct 18 to journal the valve plate relative to the duct 18. A latching arm 38 and a counterweight arm 40 extend normally in opposite direction from opposite ends of the transverse rod portion 37 outside the duct 18 and thus are coupled to the valve plate 34 so as to rotate therewith as will be described. First and second retaining means 35 and 36 interfere with the latching arm 38 to limit movement of the plate 34 and to retain the plate 34 in the desired position, as will be described with reference to FIGS. 2 and 3. The arm 40 carries a counterweight 41 which is adjustable axially of the arm 40 so as to balance the valve plate 34 and additional structure as will be described.

Figure 2:
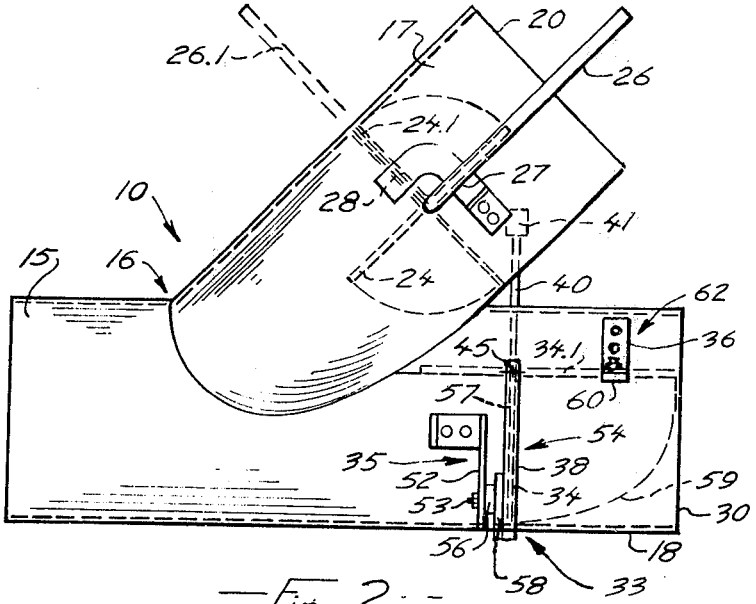
FIG. 2 is a simplified side elevation of the assembly of FIG. 1.
Figure 3:
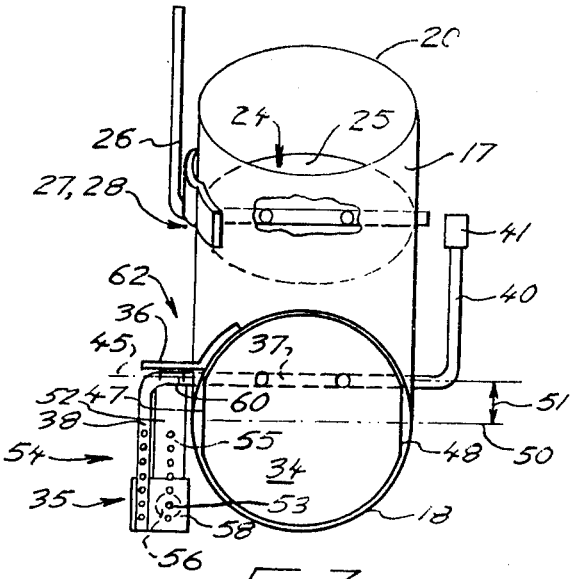
FIG. 3 is a simplified end elevation of the assembly of FIG. 1.
Figure 4:
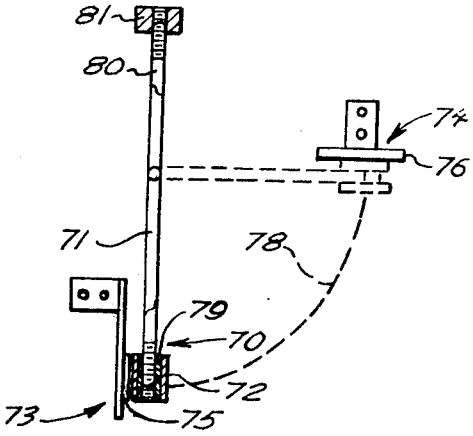
FIG. 4 is a fragmented simplified diagram of a second embodiment of the latching means, showing an alternative magnetic latching means.

FIGS. 2 and 3

The valve plate 34 is mounted for rotation about a hinge axis 45 which is co-incident with the rod portion 37. Diametrically opposite portions of the valve plate 34 are relieved at chords 47 and 48 respectively as shown to provide clearance for swinging of the valve plate in the duct through 90 degrees from the closed position to a fully open position 34.1 of the plate, shown in FIG. 2 only. Referring to FIG. 3 the plate 34 has a central axis 50 which divides the plate into two generally equal areas, the hinge axis 45 being parallel to and spaced from the central axis 50 by a spacing 51 to journal the plate off-centered. The spacing 51 causes the valve plate 34 to act similarly to a weather vane, so that when the plate is exposed to a predetermined flow of air past the plate, a force is generated on the plate which tends to swing the plate to the open position.

The latching arm 38 is a portion of a releasable latching means 54 which cooperates with the valve plate 34 to hold the valve 33 closed until automatically opened as will be described. The latching means further includes a magnet 56 secured to the first retaining means 35 and an armature 58 mounted on the latching arm 38. The magnet is adjacent an arc 59 swept by the armature 58 as the valve plate 34 and arm 38 rotate through 90 degrees about the axis 45, and is positioned adjacent the arc so that when the armature contacts the magnet 56 the valve plate is in the closed position. The magnet 56 grips the armature 58 to provide a retaining or latching force for the plate 34 sufficient to resist normal operating exhaust pressure acting on an upstream side 57 of the plate 34. The retaining means is a strip 52 having a row of openings 55 and the magnet is retained in a particular position on the strip by a screw 53 passing through one of the openings. The armature 58 on the arm 38 has sufficient length to accommodate movement of the magnet along the strip, which movement changes effective moment arm of the magnet 56 about the hinge axis 45, thus varying minimum force and therefore minimum exhaust pressure necessary to open the valve 33. It is seen that movement of the magnet 56 along the strip 52 permits fine adjustment of releasing froce for the valve assembly. The armature can also be adjustable along the arm 38 to accommodate excessive movement of the magnet.

The second retaining means 36 has a similar second magnet 60 similarly adjacent the arc 59 swept by the armature and positioned on the means 36 so that when the armature 58 contacts the second magnet 60 the valve plate 34 is in the fully opened position 34.1. The armature 58 and the magnet 60 serve as a steadying means 62 cooperating with the plate to maintain the plate, when released, in the open position in which there is negligible restriction of air flow past the automatic valve. Thus the valve plate 34 is retained either by the latching means 54 in the closed position or by the steadying means 62 in the fully open position. The counterweight 41 on the counterweight arm 40 is adjustable along the arm, i.e. radially relative to the hinge axis 45, so as to balance the weight of the valve plate and armature to ensure that the plate is free to swing to the open position when the latching means 54 releases the plate. This permits the valve 33 to operate when the duct 18 is either horizontal or vertical so that when the latching means releases the plate from the closed position, the air flowing past the plate swings the plate to the open position and the plate is retained in the open position by the steadying means until it is manually reset as will be described. In some circumstances the plate 34 can be balanced to swing to the open position and can be held there by the exhaust air flow without the magnet 60, which can therefore be eliminated. In this instance the steadying means is the off-centered valve plate by itself and if properly balanced the valve plate 34 causes negligible restriction of air flow.

OPERATION

During the summer in warm moist periods when heat and humidity from the dryer are not required, the lever 26 is swung to position 26.1 to close the manual valve 24 and thus a filter bag is not required. The automatic valve assembly 33 is swung manually by the latching arm 38 or the counterweight arm 40 to the open position and held there by the steadying means 62 so as to conduct the exhaust of the dryer to outside atmosphere. As will be described, if the valve 33 were not swung manually to the open position, it would nevertheless automatically attain the open position when the dryer was operating because the valve 24 is closed.

In the winter, when the humidity and heat from the dryer exhaust are desired inside the building, the valve assembly 33 in the duct 18 is manually closed, the valve 24 in the duct 17 is manually opened and the filter bag 22 is fitted to the open end 20 to prevent escape of lint into the building. When the dryer is operated its exhaust is filtered to pass into the building but after a period of time lint collects in the bag 22 and tends to restrict flow of air therethrough and the exhaust pressure in the ducts 15, 17 and 18 increases. When the lint blocks the filter bag to the extent that there is a material reduction in air flow from the dryer, for example when the flow is reduced by about 30 percent, sufficient excess pressure is generated in the ducts to develop a force on the upstream side 57 of the valve plate 34 to overcome the restraining force of the magnet 56 gripping the armature 58.

Experiments on the dryer can be made to ascertain what exhaust flow reduction is acceptable before the automatic valve is opened. When the exhaust flow of common residential dryers is fully restricted, a back pressure of about 1.0 inch of water is developed. To be compatible with dryer manufacturer's recommended maximum ducting pressure drop, 0.70 inches of water is selected as a typical predetermined excessive exhaust pressure. This pressure is attained at about 45 percent of the average maximum flow rating of common dryers and thus is safely above the minimum permitted flow of 30 percent. When the duct 18 is four inches in diameter and the spacing 51 between the axes 45 and 50 is 0.75 inch, a typical small commercial magnet 56 spaced at about two inches from the axis 45 has been found to release at the required pressure. Clearly, there are many variables and a wide range of parameters could produce acceptable results.

When this excessive exhaust pressure is reached in the ducts, the magnet 56 releases the armature 58 and the plate 34 swings to the open position to be held positively by the second magnet 60 gripping the armature 58. The exhaust from the dryer then passes directly to atmosphere as in the summer and it will continue to do so until the filter bag is cleaned or replaced. Note that manually swinging the valve 33 back to the closed position in an attempt to divert the dryer exhaust back into the filter bag would be of no avail as the excess exhaust pressure will rapidly develop again, thus actuating the valve 33 almost immediately to release it again to the open position. Thus if the operator of the dryer wishes to take advantage of the heat and humidity of the dryer he will have to remove or replace the filter bag.

Thus the releasable latch means 54 cooperates with the plate to hold the plate closed until a predetermined excessive exhaust pressure develops on the upstream side of the plate due to restriction of air flow through the filter of the first exhaust duct. It can be seen that the valve plate serves as a pressure sensing means exposed to exhaust pressure on the upstream side of the valve and cooperates with the latch means to trigger or release the latch means when the exhaust pressure exceeds the predetermined excessive pressure. When the arm 38 swings to contact the second means 36, it provides a visual indication for the dryer operator that the filter is blocked and that heat and humidity are being lost to atmosphere.

The duct assembly disclosed has co-axial inlet and second exhaust ducts 15 and 18, with the first exhaust duct 17 extending at 45 degrees from the junction 16. The angle of 45 degrees is preferred to reduce the excessive ducting losses with resulting increased pressure and, whilst the first and second exhaust ducts could be disposed at different angles to the inlet duct, the disposition shown is preferred.

ALTERNATIVES AND EQUIVALENTS

FIG. 4

A second embodiment of the invention is characterized by an alternative magnetic latching means 70 which cooperates with an alternative latching arm 71 which is connected to the valve plate 34 (not shown) similarly to the arm 38 of the FIG. 1 embodiment. In the alternative means 70 the armature and magnets are interchanged so that the latching arm 71 now carries an alternative magnet 72 and alternative first and second retaining means 73 and 74 secured to the duct 18, not shown, have armatures 75 and 76 respectively. Thus, as the valve plate swings between closed and open positions as before, the magnet 72 describes an arc 78. The first armature 75 is secured relative to the assembly and positioned adjacent the arc 78 so that the automatic valve is closed when the magnet 72 contacts the armature 75 as shown. It can be seen that the means 70 is clearly equivalent to the latching means 54 of FIG. 1 and functions in a similar manner. The second armature 76 is secured relative to the assembly and positioned adjacent the arc 78 at a position on the arc at which the automatic valve is open when the magnet 72 grips the second armature 76 and thus is equivalent to the steadying means 62 of FIG. 2. The magnet 72 is threaded onto an outer threaded end of the latching arm 71 so that rotation of the magnet 72 relative to the arm 71 moves the magnet axially along the arm 71 to change its position relative to the hinge axis. This is equivalent to the row of openings 55 for repositioning of the magnet 56 in FIG. 3 and is used to set the releasing force of the valve. To prevent unintentional rotation of the magnet 72 on the arm, the magnet has a hollow threaded plastic insert 79 which is complementary to the threaded outer end of the arm 71.

An alternative counterweight arm 80 is connected to the valve plate and has a counterweight 81 similarly threaded onto an outer end thereof. The valve assembly is adjusted by appropriate rotation of the magnet 72 and counterweight 81 for movement axially along the respective arms so as to obtain the desired balance of the valve assembly and to ensure attainment of the predetermined excessive exhaust pressure necessary for opening the automatic valve.

FIG. 5

A third embodiment of the invention is characterized by an over-centering latching means 85 which includes a Y-shaped member 87 having spaced upstream and downstream arms 88 and 89 and a stem portion 90. In this embodiment the latching arm is omitted and the counterweight arm and counterweight (not shown) are used for balancing the valve and for manual resetting of the valve when required. The counterweight is selected to be of sufficient weight to balance the valve plate in the open position when the exhaust flows past the valve plate. Thus the counterweight serves as a steadying means and, if properly selected, restricts the exhaust flow negligibly.

A spring housing 92 encloses the Y-shaped member and has a pin 94 which journals the Y-shaped member for rotation about an axis which is disposed between the arms and the stem portion. The housing 92 is positioned relative to the valve plate 34 so that when the means 85 is set to maintain the valve 33 closed, the downstream arm projects into the duct and is positioned downstream from the valve plate to interfere with an adjacent rim 93 of the valve plate 34 so as to prevent opening of the valve. An adjustment screw 95 is threaded onto a lower end 96 of the housing 92 and a compression spring 97 extends between the screw 95 and a plastic cap 98. The cap is forced by the spring against the stem portion 90, to bias the Y-shaped member into one of two over-centered positions, namely the closed position which is shown in full outline and an opposite open position which is shown in broken outline at 87.1. The means 85 functions similarly to the first embodiment of the invention and the force of the spring 97 and the geometry of the Y-shaped member are selected so that when the valve plate 34 is exposed to the predetermined excessive exhaust pressure on the upstream side 57 thereof, force from the spring 97 is overcome and the cap 97 moves outwards. This permits the Y-shaped member to rotate from the closed position 87, full outline, to the open position 87.1, broken outline, thus permitting the valve plate 34 to swing in direction of an arrow 99 to open the valve (not shown). When the valve is opened, the upstream arm 88 is seen to project into the duct 18, preventing the valve from swinging upstream should the exhaust flow cease. It can be seen that fine adjustment of the screw 95 and the spring 97 and selection of appropriate geometry of the Y-shaped member permit fine adjustment attainable with the magnetic latching means 54 and 70 as previously described.

When the valve 33 has opened, the filter is cleaned over replaced and the operator can then manually reset the valve. For manual resetting, the valve is swung by the counterweight arm, not shown, in a direction opposite to the arrow 99 so that the rim 93 of the valve plate 34 interferes with the upwardly projecting upstream arm 88. The force from the spring 98 is overcome and the plate can then swing to the closed position in which the downstream arm 89 once again projects inwards into the duct to prevent the valve opening until the predetermined excessive exhaust pressure is reached again.

FIG. 6

Figure 5:
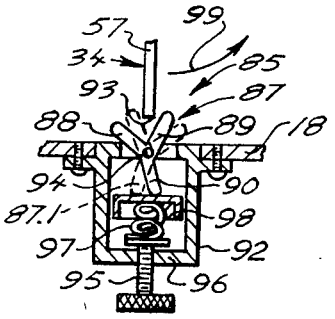
FIG. 5 is a detailed fragmented section of a third embodiment of the latch means, showing an overcentering latching means.

A fourth embodiment of the invention is characterized by a resilient latching means 101 which cooperates with the rim 93 of the valve plate 34 similarly to the over-centering latching means of FIG. 5. In this embodiment also, the latching arm can be eliminated and the counterweight arm is maintained for balancing and manual control of the valve. The alternative means 101 has a spring and ball housing 104 secured to the duct 18 as shown, the housing having an inner end having an opening 105 and an adjustment screw 106 threaded in an outer end of the housing. A ball 108 is forced against a periphery of the opening 105 by a spring 109 which extends between the ball 108 and the adjusting screw 106. The opening at the inner end has a diameter less than the diameter of the ball so that the ball interferes with the periphery of the spring and a portion of the ball projects through the open end into the duct sufficiently to interfere with the rim 93 of the valve plate 34. The valve plate is positioned on an upstream side of ball 108 and is held against the ball by exhaust pressure acting on the upstream side 57 of the plate. When the ball is depressed sufficiently, the rim 93 passes over the ball to permit the valve to open. The screw 106 provides fine adjustment of the force necessary to press the ball outwardly which permits the valve plate to swing in direction of an arrow 111 to open the valve.

Figure 6:
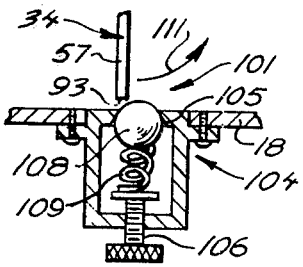
FIG. 6 is a detailed fragmented section of a fourth embodiment of latch means, showing a resilient latching means.
Figure 7:
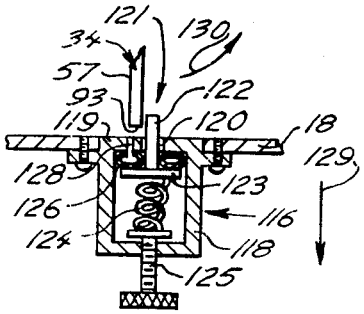
FIG. 7 is a detailed fragmented section of a fifth embodiment of a latch means, showing a pneumatic latching means.

It can be seen that the third and fourth embodiments of the invention 85 and 101 are equivalent and both include equivalent releasable latch means which include detent and spring means, the detent being urged by the spring means to a raised position in which the detent projects sufficiently into the second exhaust duct to interfere with the valve plate to hold the valve plate in the closed position when the exhaust pressure is less than the predetermined pressure. In the FIG. 5 embodiment the detent is the Y-shaped member 87, and in the FIG. 6 embodiment the detent is the ball 108. In the embodiments of FIGS. 5 and 6 it is seen the valve plate serves as a pressure sensing means exposed to exhaust pressure and cooperating with the respective latch means and thus functions similarly to the FIG. 1 embodiment. The magnetic latching means 54 and 70 are shown to cooperate with the valve plate indirectly outside the duct, and the detent and spring means of FIGS. 5 and 6 cooperate with the valve plate directly inside the duct. These can be reversed so that the magnets cooperate directly with the plate in the duct and the detent and spring means can be made to cooperate indirectly with the plate outside the duct, i.e. with the latching arm.

FIG. 7

A fifth embodiment of the invention is characterized by a pneumatic latching means 116 which similarly cooperates with the rim 93 of the valve plate 34, so that the latching arm can be eliminated. The means 116 includes a spring and plunger housing 118 secured to the duct 18 adjacent the valve plate 34. The housing has an inner end 119 having an opening 120 which is positioned adjacent the rim 93 of the valve plate 34. The means 116 has a plunger 121 having a stem portion 122 projecting inwards through the opening 120, and a cap portion 123. A compression spring 124 extends between an adjustment screw 125 at an outer end of the housing and the cap portion 123 of the plunger 121, thus tending to force the plunger inwards so that the stem portion projects into the duct to interfere with the valve plate. A flexible annular bellows 126 is fitted between the inner end 119 and the cap portion 123 and encircles the plunger stem portion 122 as shown. The inner end 119 has a bleed opening 128 on an upstream side of the valve plate 34, which opening communicates with the interior of the annular bellows 126. Thus, through the opening 128, the bellows 126 is exposed to exhaust pressure on upstream side 57 of the valve plate 34. The bellows is made of a flexible impermeable material so that when the filter becomes blocked sufficiently for the predetermined excessive exhaust pressure to be generated on the upstream side of the plate, the bellows is exposed to this pressure through the opening 128 and the bellows expands. The spring 124 is relatively light so that as the bellows expands the plunger moves outwards in direction of an arrow 129, causing the plunger 121 to retract from the wall of the duct 18 to release the rim 93, to permit the valve plate 34 to swing in direction of the arrow 130 to the open position, not shown.

It is seen that the pneumatic latching means 116 is responsive to exhaust air pressure upstream of the valve plate and thus is equivalent to the previously described magnetic, over-centering and resilient latching means. The bellows is thus an expansible chamber which serves as a pressure sensing means exposed to exhaust air pressure on the upstream side of the valve plate. The plunger 121 serves as the releasable latch means cooperating with the plate to hold the plate closed until the predetermined excessive exhaust pressure is developed on the upstream side of the plate. It is seen that the pressure sensing means, i.e. the bellows, cooperates with the latch means to release the latch means when the excessive exhaust pressure is developed.

It is noted that in all non-magnetic latching means the air flow past the valve plate and the counterweight on the counterweight arm serves as steadying means to hold the valve plate in the open position when the latch means is released.

We claim:

1. An automatic valve assembly for use with a clothes dryer having an exhaust opening within a building, the valve assembly communicating with an inlet duct which is connected to the dryer exhaust opening, and dividing at a duct junction into first and second exhaust ducts; the first exhaust duct exhausting into the building, carrying a filter and having a manual valve adapted to close or open the first duct; the second exhaust duct exhausting outside the building and carrying the automatic valve assembly; the automatic valve assembly being characterized by:

i. a valve plate mounted for rotation about a hinge axis between closed and open positions, the plate having a central axis which divides the plate into two generally equal areas, the hinge axis being parallel to and spaced from the central axis to journal the plate off-centered so that when the plate is exposed to a predetermined flow of air a force on the plate is generated which tends to swing the plate towards the open position, ii. releasable latch means cooperating with the plate to hold the plate closed until a predetermined excessive exhaust pressure is developed on an upstream side of the plate due to restriction of exhaust flow through the filter in the first exhaust duct, iii. pressure sensing means exposed to exhaust pressure on the upstream side of the valve plate and cooperating with the latch means to release the latch means when the exhaust pressure exceeds the predetermined excessive pressure, iv. steadying means cooperating with the plate to maintain the plate, when released, in the open position in which there is negligible restriction of air flow past the automatic valve.

2. An automatic valve assembly as claimed in claim 1 in which:

i. the pressure sensing means includes the valve plate, ii. and the releasable latch means includes a magnet cooperating with the valve plate to hold the plate in the closed position until the predetermined excessive exhaust pressure is reached.

3. An automatic valve assembly as claimed in claim 2 in which the releasable latch means further includes:

i. a latching arm positioned outside the second exhaust duct and cooperating with the valve plate so as to describe an arc when the valve plate swings between open and closed positions, ii. a first retaining means secured to the assembly adjacent the arc described by the arm, the retaining means being positioned so that when the magnet cooperates with the arm and the retaining means, the valve plate is held closed until the predetermined excessive exhaust pressure is developed.

4. An automatic valve assembly as claimed in claim 1 in which the steadying means includes:

i. a magnet cooperating with the valve plate to hold the plate in the open position after the latching means has released the plate.

5. An automatic valve assembly as claimed in claim 3 in which:

i. the magnet is secured to the latching arm so as to describe an arc as the valve plate swings between open and closed positions, ii. the retaining means has a first armature positioned adjacent the arc swept by the magnet so that the automatic valve is closed when the magnet grips the first armature, iii. the steadying means has a second armature positioned adjacent the arc swept by the magnet so that the automatic valve is open when the magnet grips the second armature.

6. An automatic valve assembly as claimed in claim 1 in which:

i. the pressure sensing means includes the valve plate, and the latch means is adjacent a wall of the second duct and is characterized by:

ii. a detent and spring means, the detent being urged by the spring means to a raised position in which the detent projects sufficiently into the second exhaust duct to interfere with the valve plate to hold the valve plate in closed position when the exhaust air pressure is below the predetermined pressure.

7. An automatic valve assembly as claimed in claim 6 in which:

i. the detent is a ball, and the latch means further includes:

ii. a spring housing containing the spring means, the housing having an open inner end which has a diameter less than the diameter of the ball but of sufficient size to permit the ball to protrude through the open end sufficiently to project into the duct to interfere with the valve plate.

8. An automatic valve assembly as claimed in claim 6 in which:

i. the detent means is characterized by a Y-shaped member having spaced up-stream and downstream arms and a stem portion disposed outwardly of the arms, the Y-shaped member being journalled for rotation on an axis which is disposed between the arms and the stem portion, the downstream arm being positioned so as to project into the duct to interfere with an adjacent rim of the valve plate when the plate is in the closed position, ii. the spring means cooperates with the Y-shaped member to force it into one of two over-centered positions in which one of the arms projects into the duct to interfere with the rim of the valve plate.

9. An automatic valve assembly as claimed in claim 1 in which the steadying means is characterized by:

i. a counterweight cooperating with the valve plate so as to hold the valve plate in the open position when the latch means is released and the valve plate is exposed to exhaust flow.

10. An automatic valve assembly as claimed in claim 1 in which the releasable latch means is a pneumatic latching means and the pressure sensing means includes:

i. an expansible chamber means exposed to exhaust air pressure on an upstream side of the valve plate, and the releasable latch means includes:

ii. a plunger and spring means, the spring forcing the plunger to extend into the second duct so as to interfere with the valve plate to hold it closed when exhaust air pressure is below the pre-determined excessive exhaust air, the expansible chamber cooperating with the plunger so that as the bellows expands due to excessive exhaust pressure, the plunger retracts from the duct to permit the valve to open.

11. A heater/humidifier converter for a clothes dryer having an exhaust opening within a building, the converter being characterized by:

i. a bifurcated duct assembly including an inlet duct adapted to communicate with the exhaust opening in the dryer, the duct dividing at a junction into a first exhaust duct which exhausts into the building, and a second exhaust duct which exhausts outside the building, ii. the first exhaust duct being adapted to accept a filter and having a manual valve adapted to close or open the first exhaust duct, iii. the second exhaust duct having an automatic exhaust pressure responsive valve assembly characterized by:

a. a valve plate mounted for rotation about a hinge axis between closed and open positions, the plate having a central axis which divides the plate into two generally equal areas, the hinge axis being parallel to and spaced from the central axis to journal the plate off-centred so that when the plate is exposed to a predetermined flow of air a force on the plate is generated which tends to swing the plate to the open position, b. releasable latch means cooperating with the plate to hold the plate closed until a predetermined excessive exhaust pressure is developed on an upstream side of the plate due to restriction of exhaust flow through the filter in the first exhaust duct, c. pressure sensing means exposed to exhaust pressure on the upstream side of the valve plate and cooperating with the latch means to release the latch means when the exhaust pressure exceeds the predetermined excessive pressure, d. steadying means cooperating with the plate to maintain the plate, when released, in the open position in which there is negligible restriction of air flow past the automatic valve.

12. A heater/humidifier converter as claimed in claim 11 in which:

i. the pressure sensing means includes the valve plate, ii. and the releasable latch means includes a magnet cooperating with the valve plate to hold the plate in the closed position until the predetermined excessive exhaust pressure is reached.

13. A heater/humidifier converter as claimed in claim 11 in which:

i. the pressure sensing means includes the valve plate, and the latch means is adjacent a wall of the second duct and is characterized by:

ii. a detent and spring means, the detent being urged by the spring means to a raised position in which the detent projects sufficiently into the second exhaust duct to interfere with the valve plate to hold the valve plate in the closed position when the exhaust air pressure is below the predetermined pressure.

14. A heater/humidifier converter as claimed in claim 11 in which the releasable latch means is a pneumatic latching means and the pressure sensing means includes:

i. an expansible chamber means exposed to exhaust air pressure on an upstream side of the valve plate, and the releasable latch means includes:

ii. a plunger and spring means, the spring forcing the plunger to extend into the second duct so as to interfere with the valve plate to hold it closed when exhaust air pressure is below the pre-determined excessive exhaust air, the expansible chamber cooperating with the plunger so that as the bellows expands due to excessive exhaust pressure, the plunger retracts from the duct to permit the valve to open.

* * * * *